United States Patent [19]

Vorkapich

[11] 4,176,718

[45] Dec. 4, 1979

[54] ANTI-LODGEMENT BAIL FOR SPRINKLERS

[75] Inventor: Theodore Vorkapich, Brunswick, Ohio

[73] Assignee: A-T-O Inc., Willoughby, Ohio

[21] Appl. No.: 873,222

[22] Filed: Jan. 30, 1978

[51] Int. Cl.[2] ..... A62C 37/12

[52] U.S. Cl. ..... 169/39; 169/37

[58] Field of Search ..... 169/37–41

[56] References Cited

U.S. PATENT DOCUMENTS

| | | | |
|---|---|---|---|
| 1,115,930 | 11/1914 | Hawkins | 169/39 |
| 1,749,627 | 3/1930 | Carlson | 169/40 |
| 1,919,235 | 7/1933 | Loepsinger | 169/39 |
| 3,561,537 | 2/1971 | Dix et al. | 169/38 |
| 4,029,150 | 6/1977 | Goodsell, Jr. | 169/39 |

*Primary Examiner*—Robert J. Spar
*Assistant Examiner*—Charles A. Marmor
*Attorney, Agent, or Firm*—Webster B. Harpman

[57] ABSTRACT

An anti-lodgement bail or guard is positioned on the strut of a sprinkler used in a fire extinguishing system to prevent the strut and lever from undesired lodgement against the deflector of the sprinkler as may otherwise occur when the sprinkler fuses.

3 Claims, 6 Drawing Figures

ANTI-LODGEMENT BAIL FOR SPRINKLERS

BACKGROUND OF THE INVENTION

1. Field of the Invention

This invention relates to sprinklers of the type normally employed in fire extinguishing sprinkler systems.

2. Description of the Prior Art

A typical sprinkler to which the anti-lodgement bail may be readily applied is illustrated in U.S. Pat. No. 4,029,150 wherein a strut a lever and a fusible element assembly is positioned between the deflector and the closure cap of the sprinkler.

The present invention adds an anti-lodgement bail or guard to the strut of the sprinkler which prevents it from lodging against the deflector of the sprinkler and thereby avoids the undesirable spray pattern which occurs when the strut lodges against the deflector.

SUMMARY OF THE INVENTION

A sprinkler having an apertured body defining a fluid delivering passageway normally closed by a closure cap includes a frame positioning a deflector in spaced opposed relation to the fluid passageway. A strut, lever and fusible element assembly is positioned between the deflector and the closure cap and the strut is provided with an anti-lodgement bail or guard which extends outwardly therefrom and prevents the strut from lodging against the deflector of the sprinkler when the sprinkler fuses and fire extinguishing liquid is delivered through the fluid passageway.

DESCRIPTION OF THE PREFERRED EMBODIMENT

Figure 1:
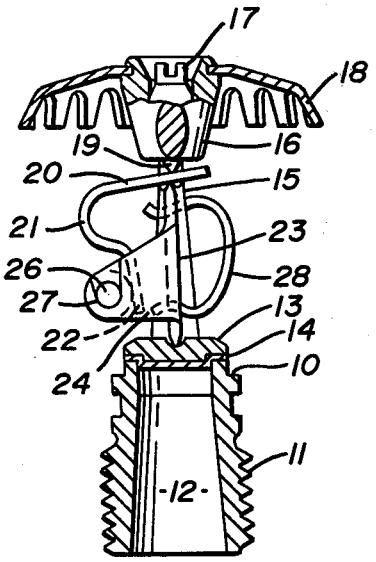
FIG. 1 is a vertical section through a sprinkler embodying the present invention.
Figure 2:
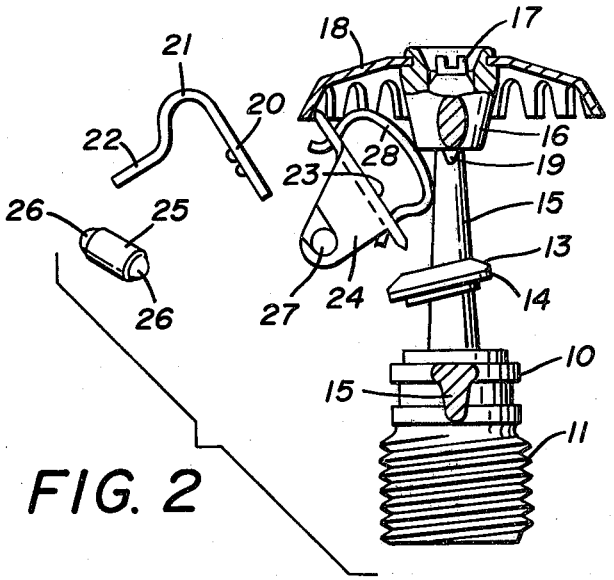
FIG. 2 is an exploded view comparable to FIG. 1 showing the repositioning of the parts when the sprinkler fuses.

In the form of the invention chosen for illustration herein and as best seen in FIGS. 1 and 2 of the drawings, the sprinkler provided with the anti-lodgement bail comprises an apertured body member 10, the lower portion of which is externally threaded as at 11 so that it can be turned into a pipe fitting in a sprinkler system. The apertured body member 10 defines a fluid passageway 12 and the discharge end thereof is normally closed by a closure cap 13 and a gasket 14. A frame formed of oppositely disposed spaced arms 15 is integrally formed with the body member 10 and the outer ends of the arms 15 are joined as at 16 to form a passageway in which a stakable compression screw 17 is positioned. A deflector 18 is secured to the outer end of the frame. The compression screw 17 extends inwardly of the junction 16 of the arms 15 and it lies on the axial center line of the fluid delivery passageway 12 of the sprinkler. The inner end of the screw 17 is pointed as at 19 for registry with a depression in a substantially horizontal portion 20 of an angularly shaped lever 21. A lower substantially vertically positioned portion 22 of the angularly shaped lever 21 is positioned in horizontally spaced relation to a strut 23, the upper end of which engages the substantially horizontal portion 20 of the lever 21 and the lower end of the strut 23 engages the closure cap 13. The strut 23 has a pair of oppositely disposed sidewardly extending apertured arms 24 formed integrally therewith and inwardly of its upper and lower ends. The substantially vertical portion 22 of the lever 21 extends into the area between the arms 23. A fusible element including a tubular body 25 is positioned between the apertured arms 24 so that a pair of spheres 26 positioned partially within the ends of the tubular body 24 are also partially engaged in oppositely disposed apertures 27 in the outer portions of the arms 24. A pellet of fusible material is positioned within the tubular body 25 and between the spheres 26 and arranged so that upon reaching a predetermined temperature such as 165° F. the fusible material will soften and permit the spheres 26 to move inwardly of the tubular body 25 whereupon the assembly including the lever 21 and the strut 23 will move away from their normal position and permit the opening of the closure cap 13 responsive to fluid pressure thereagainst.

An anti-lodgement bail or guard 28 is attached to the strut 23 and in oppositely disposed relation to the sidewardly extending apertured arms 24. As seen in FIG. 1 and 2 of the drawings, the anti-lodgement bail or guard 28 takes the form of a piece of stiff wire of a widened generally U-shape, the curved ends of which are engaged in vertically spaced apertures in the strut 23 so as to position the anti-lodgement bail as shown.

By referring now to FIG. 2 of the drawings, an exploded view of the sprinkler of FIG. 1 may be seen following the fusing of the material in the tubular body 25 and the displacement of the lever 21 and the strut 23 and closure cap 13 as occurs when the sprinkler opens.

In FIG. 2 of the drawings it will be seen that the strut 23 has moved upwardly toward the deflector 18 and partially engages the same. The bail or guard 28 also engages the sprinkler and holds the strut 23 so that it will move outwardly from under the deflector 18 and not lodge thereagainst. This occurs because the fire extinguishing fluid discharging from the passageway 12 will force the strut 23 outwardly with respect to the arms 15 of the sprinkler and prevent such lodgement.

Figure 3:
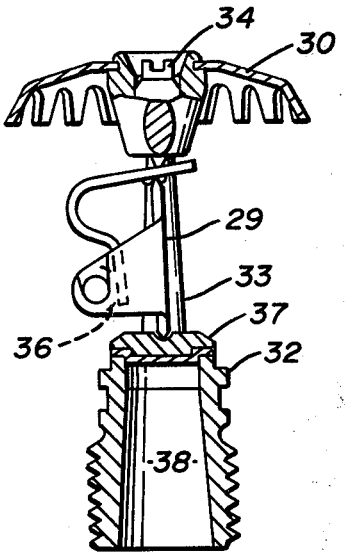
FIG. 3 PRIOR ART
FIG. 3 is a vertical section of a prior art sprinkler without the anti-lodgement bail.
Figure 4:
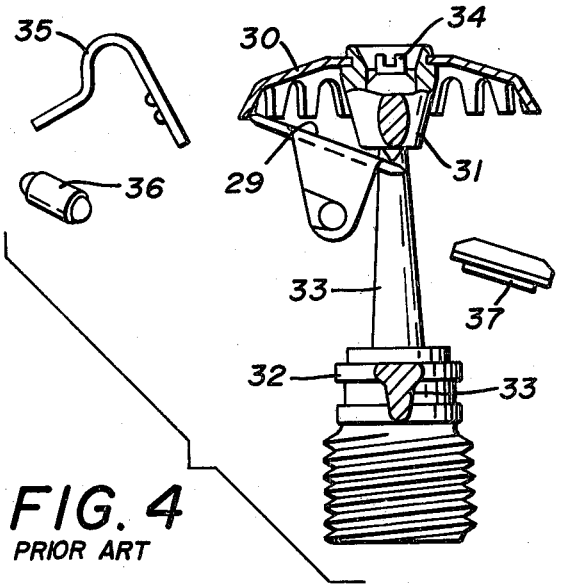
FIG. 4 PRIOR ART
FIG. 4 is an exploded view showing the parts of the prior art sprinkler after fusing and illustrating the undesirable positioning of one of the parts so as to interfere with the spray pattern.

In order that the improvement herein disclosed and its operation can be compared with a prior art sprinkler, FIGS. 3 and 4 of the drawings illustrate a prior art sprinkler which is the same as the sprinkler of FIG. 1 and 2 and heretofore described except that the strut 29 of the prior art sprinkler will upon being released by the fusing of the sprinkler lodge against a deflector 30 and a portion 31 of the prior art sprinkler as seen in FIG. 4 of the drawings. In such position the fire extinguishing fluid emerging from the passageway through the base of the sprinkler will engage against the downward surface of the strut 29 and hold it in lodged position as shown in FIG. 4 whereupon the spray pattern of the sprinkler will be seriously altered and the sprinkler will not therefore cover the desired area in a fire controlling operation.

In FIGS. 3 and 4 of the drawings the prior art sprinkler body is indicated at 32, the arms extending outwardly and upwardly adjoined thereabove are indicated at 33 and the deflector 30 is carried on the upper ends thereof by a compression screw 34. The angularly shaped lever is shown at 35 and the fusible material carrying tubular body at 36. As seen in FIG. 3 of the drawings, the fusible element assembly normally holds the closure cap 37 on the fluid passageway 38.

Figure 5:
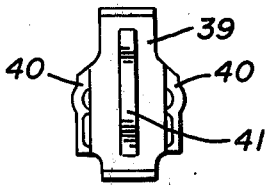
FIG. 5 is a plan view of the strut of a fusible element assembly showing a modified anti-lodgement bail.
Figure 6:
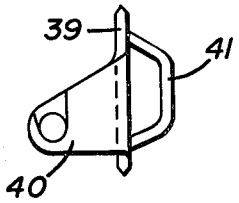
FIG. 6 is a side elevation of the modification of FIG. 5.

Modifications in the anti-lodgement bail or guard comprising the novelty in the present disclosure will occur to those skilled in the art and one such modification may be seen in FIGS. 5 and 6 of the drawings. By referring thereto it will be seen that a strut 39 has a pair of spaced outwardly extending apertured arms 40 on one side thereof and that an anti-lodgement bail or guard 41 is formed integrally therewith by cutting a pair of slits vertically in the strut 39 as best seen in FIG. 5 and distorting the material therebetween outwardly in a direction opposite to that of the arms 40 as best seen in FIG. 6 of the drawings.

Whether the anti-lodgement bail takes the form of the wire-shape 28 of FIGS. 1 and 2 of the drawings and heretofore described or the integral distorted or expanded section of metal of the strut 39 as in FIGS. 5 and 6 of the drawings is immaterial. In either case the provision of the anti-lodgement bail or guard will prevent the strut when freed from the fusible element assembly from assuming a position where the discharging fire extinguishing fluid will hold it against the other parts of the sprinkler where it would interfere with the desirable spray pattern.

It will thus be seen that an improvement in a sprinkler has been disclosed in the provision of an anti-lodgement bail or guard which insures the satisfactory operation of the sprinkler with respect to its spray pattern and area coverage when it discharges fire extinguishing fluid as in the case of the fire.

Having thus described my invention what I claim is:

1. The combination of a sprinkler having a body member with a fluid delivery passageway therethrough, oppositely disposed arms on the body member joined at their outer ends to form a frame, a deflector on said frame and a closure on said fluid delivery passageway, an assembly comprising a lever, a strut having a pair of spaced sidewardly extending apertured arms on one side thereof and a fusible element, said assembly disposed between said deflector and said closure; and an anti-lodgement bail on said strut and extending outwardly from the opposite side thereof with respect to said arms, a major portion of said bail being longitudinally arcuate and positioned in spaced substantially parallel relation to said strut, said bail arranged for registry against said frame and deflector of said sprinkler when said assembly is freed by action of the fusible element so as to space said strut and the arms thereon with respect to said frame and said deflector.

2. The combination set forth in claim 1 and wherein the anti-lodgement bail comprises a section of wire of substantial widened U-shape attached to said strut.

3. The combination set forth in claim 1 and wherein said anti-lodgement bail comprises an integral part of said strut substantially separated therefrom and bowed outwardly with respect thereto.

* * * * *